United States Patent [19]

Melnyk

[11] Patent Number: 4,458,749

[45] Date of Patent: Jul. 10, 1984

[54] RADIATOR HAVING REINFORCED TUBES

[75] Inventor: William Melnyk, Lathrup Village, Mich.

[73] Assignee: Ex-Cell-O Corporation, Troy, Mich.

[21] Appl. No.: 485,998

[22] Filed: Apr. 18, 1983

[51] Int. Cl.[3] ..... F28D 1/00

[52] U.S. Cl. ..... 165/148; 165/175; 165/DIG. 9

[58] Field of Search ..... 165/153, 148, 177, 172, 165/170, 175, DIG. 9; 138/38, 44, 172, 109

[56] References Cited

U.S. PATENT DOCUMENTS

| | | | |
|---|---|---|---|
| 2,017,201 | 10/1935 | Bossart et al. | 165/151 |
| 2,080,626 | 5/1937 | Mojonnier | 138/38 |
| 2,105,267 | 1/1938 | Robertson | 165/148 |
| 2,285,225 | 6/1942 | Norris | 165/170 |
| 4,159,034 | 6/1979 | Bellovary et al. | 165/153 |

FOREIGN PATENT DOCUMENTS

| | | | |
|---|---|---|---|
| 961934 | 4/1957 | Fed. Rep. of Germany | 138/172 |
| 580652 | 9/1944 | United Kingdom | 165/153 |

*Primary Examiner*—William R. Cline
*Attorney, Agent, or Firm*—John P. Moran

[57] ABSTRACT

The drawings and description disclose a radiator having top and bottom tanks with their respective headers, and a core assembly therebetween. The latter includes a group of fins and tubes, wherein each tube has a flattened, oblong body section, cylindrical end sections for connection with the respective headers, and transition sections between the flattened body and the cylindrical ends. Reinforcement means is provided for preventing collapsing or pinching at the ends of the flattened body section due to stressing of the tube or flexing of the headers. The reinforcement means is in the form of various shaped pairs of outwardly extending reinforcement ribs formed on opposite sides of the transition section, or inwardly extending dimples formed on opposite sides of the flattened body section adjacent the transition section.

5 Claims, 9 Drawing Figures

RADIATOR HAVING REINFORCED TUBES

TECHNICAL FIELD

This invention relates generally to radiators and, more particularly, to the tube-to-header arrangements within radiators.

BACKGROUND ART

Heretofore, it has been common practice to utilize either cylindrical tubes or tubes having an oblong shape with the narrow sides rounded extending between the top and bottom headers of a radiator. It has additionally been advocated in Bellovary et al U.S. Pat. No. 4,159,034 to use tubes having such oblong shaped bodies which are formed at the opposite ends thereof into cylindrical shapes for generally easier connection to the respective top and bottom headers. Robertson U.S. Pat. No. 2,105,267 illustrates an oval-to-cylindrical tube arrangement. It is important in such arrangements that the transition section from the flattened body to the cylindrical end be able to withstand stressing during assembly, and/or loading by of the header after assembly, without collapsing or bending and thus pinching off the flow area through the juncture between the body and the transition section.

DISCLOSURE OF THE INVENTION

Accordingly, a general object of this invention to provide an improved oblong-to-cylindrical tube for connection with a header so as to be able to withstand such stressing and flexing.

Another object of the invention is to provide a tube-to-header arrangement including a tube having an oblong or flattened body and a cylindrical end, wherein reinforcement ribs are formed on opposite sides of the transition section between the flattened body and each cylindrical end to thereby direct any loading to the cylindrical end portion itself, thus reducing any tendency of the tube wall at the juncture of the flattened body and the transition section to collapse and pinch off the flow area.

A further object of the invention is to provide a tube-to-header arrangement including a tube having an oblong body with the narrow sides rounded and a cylindrical end, wherein dimples are formed on opposite sides of the body, so as to be in contact with one another at the centers of the wide and parallel sides of the body, and immediately adjacent the transition section, to thereby prevent the tube from collapsing, the dimples being such that they do not significantly impede coolant flow through the flow area.

These and other objects and advantages will be apparent when reference is made to the following description and accompanying drawings.

BEST MODE OF CARRYING OUT THE INVENTION

Figure 1:
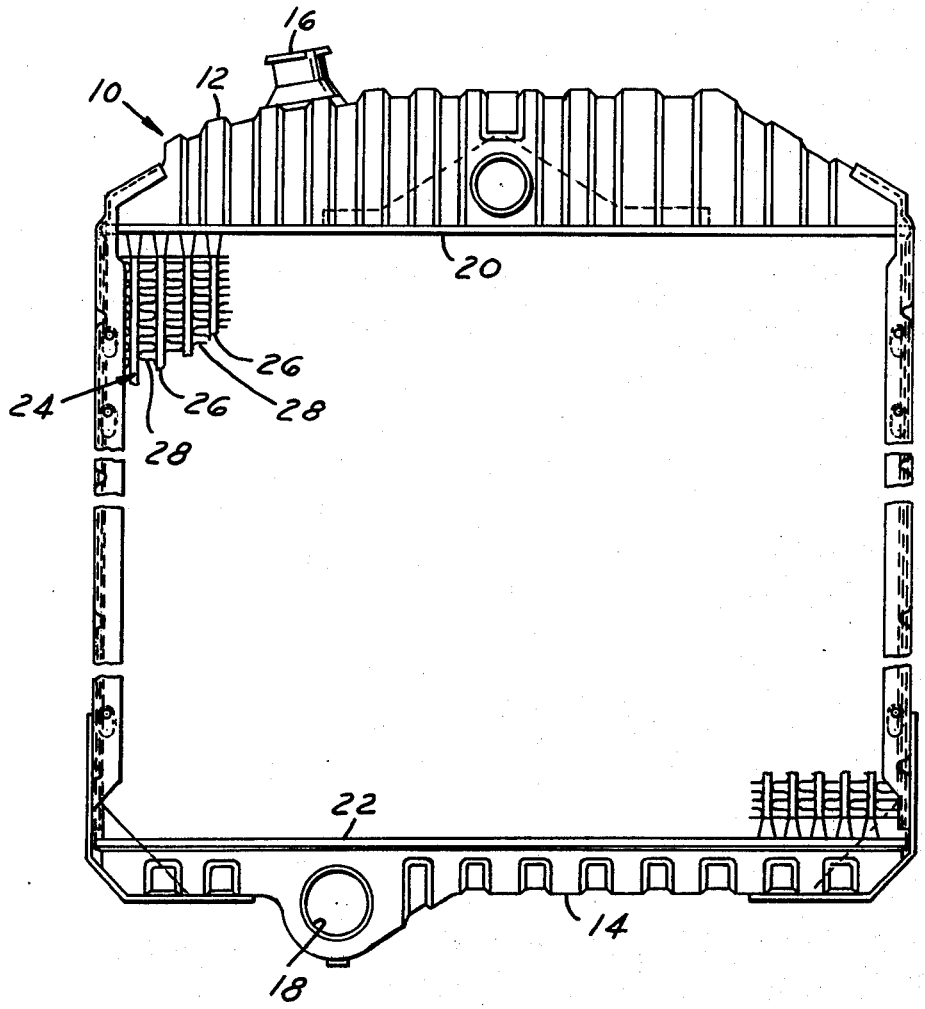
FIG. 1 is a front elevational view of a radiator embodying the invention.
Figure 2:
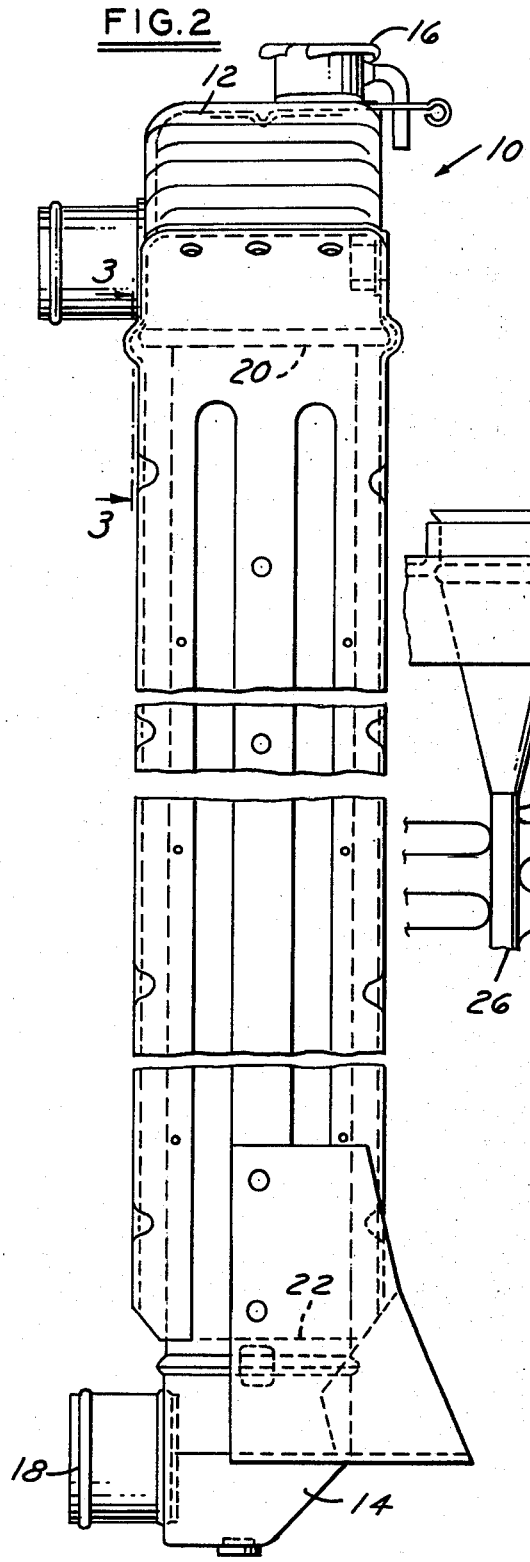
FIG. 2 is a side view taken along the plane of the line 2—2 of FIG. 1, and looking in the direction of the arrows.
Figure 3:
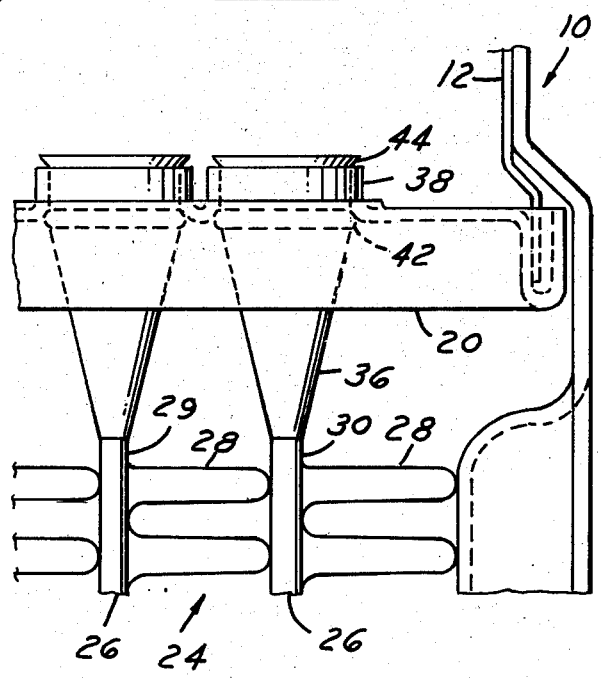
FIG. 3 is a fragmentary cross-sectional view taken along the plane of the line 3—3 of FIG. 2, and looking in the direction of the arrows.

Referring now to the drawings in greater detail, FIGS. 1-3 illustrate a radiator 10 including top and bottom tanks 12 and 14, respectively, having respective inlet and outlet connections 16 and 18 and respective headers 20 and 22, and a core assembly 24 intermediate the top and bottom headers. The core assembly includes a plurality of equally spaced vertically oriented tubes 26 and intermediate serpentine fins 28. In some applications, transversely oriented flat sheet metal fins may be used in lieu of the serpentine fins. Each tube 26 is formed to include a body section 29 having flattened, parallel sides 30 and rounded interconnecting narrow edges 32, cylindrical end sections 34 at each end thereof, and a transition section 36 between the body portion 29 and each of the cylindrical end portions 34. The cylindrical ends are extended through outwardly extending flanges 38 formed around openings 40 in the headers 20 and 22, and secured therein in any convenient manner, such as by soldering.

Figure 4:
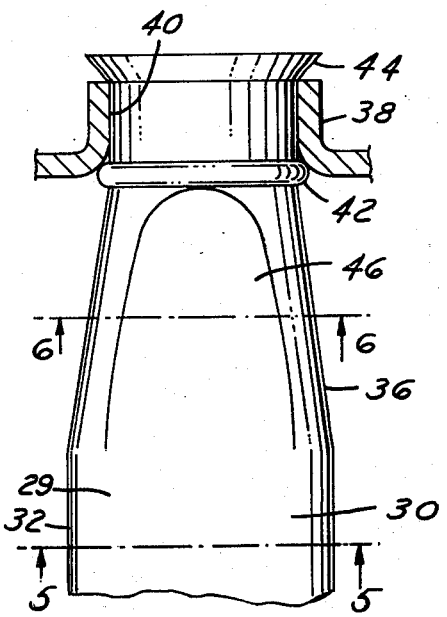
FIG. 4 is an enlarged fragmentary view of a tube-to-header connection embodying the invention.
Figure 5:
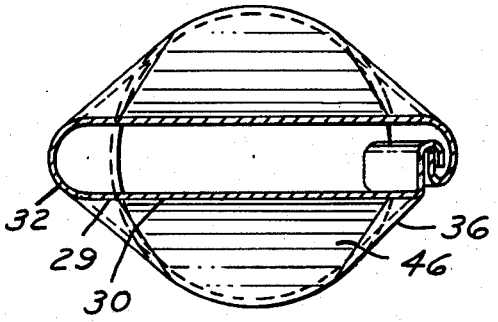
FIGS. 5 and 6 are cross-sectional views taken along the respective planes of lines 5—5 and 6—6 of FIG. 4 and looking in the directions of the arrows.
Figure 6:
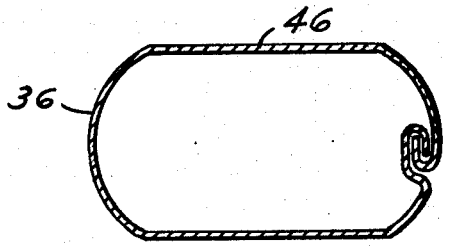

As shown in FIG. 4, an annular locking rib 42 is formed on the cylindrical end 34 so as to abut against the inside edge of the respective opening 40. Once the end 34 has been installed, a flare 44 is formed on the extended free end of the tube 26 adjacent the outer end of the outwardly flanged opening 38 to assure retention of the cylindrical end therein.

Referring once again to FIG. 4, a reinforcement rib 46 is formed on opposite sides of the tube transition section 36 from the oblong body portion 29 to each cylindrical end portion 34, extending the full length of such transition section to add strength to the latter section. The rib 46 is a flat surfaced configuration which is widest at the flattened sides 30 of the body portion 29 and narrowest at the cylindrical end portion 34, being formed in substantially an inverted "V" shape on the top transition section and in substantially a "V" shape on the bottom transition section, with the wide end thereof terminating at the connection or juncture between the transition section and the flattened, parallel sides, and the narrow end thereof terminating at the connection or juncture between the transition section and the cylindrical end section.

Figure 7:
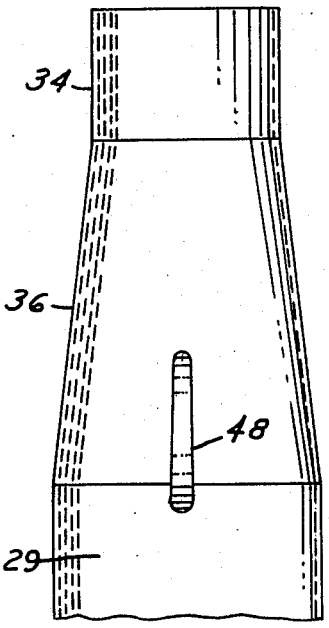
FIG. 7 is a view similar to FIG. 4 illustrating an alternate embodiment of the invention.
Figure 8:
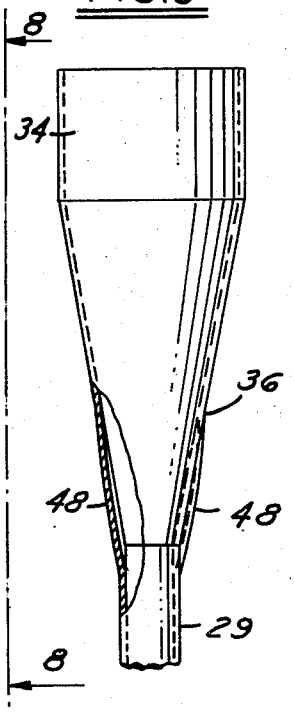
FIG. 8 is a fragmentary side view taken along the plane of the line 8—8 of FIG. 7, and looking in the direction of the arrows.

As an alternate feature, in lieu of the pair of reinforcement ribs 46, or in addition thereto, a pair of short, narrow reinforcement ribs 48 (FIGS. 7 and 8) may be formed on each transition section 36 at the juncture with the flattened sides 30. More specifically, each rib 48 extends from the juncture onto the transition section for a distance equal to approximately three-eighths of the length of the latter, and onto the flattened section 30 for a distance equal to approximately one-fifth of the rib distance as extending onto the transition section.

Figure 9:
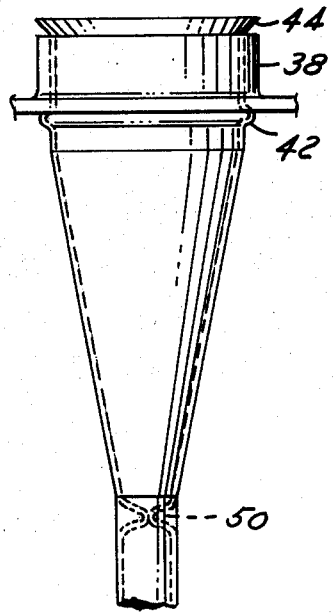
FIG. 9 is a view similar to FIG. 8 illustrating an alternate embodiment of the invention.

A further alternate feature is shown in FIG. 9. In lieu of the reinforcement ribs 46, or in addition thereto, directly oppositely disposed dimples 50 may be formed inwardly on the flattened sides 30 at the centerline thereof immediately adjacent the beginning of each transition section 36. The dimples 50 contact one another at their inner ends, preventing buckling or bending of the flattened body portion 29 relative to the adjacent transition section 36.

INDUSTRIAL APPLICABILITY

It should be apparent that the invention provides an improved reinforcement means for preventing collapse of oblong-to-cylindrical type tubes during or after being connected to the headers of a radiator.

While several embodiments of the invention have been shown and described, other modifications thereof are possible.

The embodiments of the invention in which an exclusive property or privilege is claimed are defined as follows:

1. A radiator comprising upper and lower tanks, including respective upper and lower headers, a plurality of tubes, each of said tubes having a body section with flattened, parallel sides and interconnecting rounded edges, a cylindrical end section, and a transition section therebetween terminating at junctures with each of said cylindrical end section and said flattened, parallel sides, means for connecting each of said plurality of tubes at their cylindrical ends to the respective upper and lower headers, and rib type reinforcing means formed on opposite sides of said tubes in an oppositely disposed relationship adjacent the juncture between each transition section and the adjacent flattened, parallel side to prevent collapsing of said tubes tending to pinch off the flow area through said last mentioned juncture.

2. The radiator described in claim 1, wherein said rib type reinforcing means is a pair of substantially V-shaped ribs formed on said transition section with the wide end of each V-shape terminating at the juncture with the respective flattened, parallel sides of said body section and the narrow end of each V-shaped terminating at the edge of the juncture with the cylindrical end.

3. The radiator described in claim 1, wherein said rib type reinforcing means is a pair of narrow, outwardly projecting ribs formed on the transition section adjacent the flattened sides of the body section along the centerline thereof for a predetermined distance, and extending across the juncture with the flattened, parallel sides for a distance therealong less than said predetermined distance.

4. The radiator described in claim 3, wherein said predetermined distance is approximately three-eighths of the length of the transition section, and said distance less than said predetermined distance is approximately one-fifth of said predetermined distance.

5. The radiator described in claim 1, wherein said rib type reinforcing means is a pair of dimples formed directly opposite one another on said flattened, parallel sides of said body at substantially the centerline thereof immediately adjacent the juncture with said transition section, said dimples abutting against one another at their respective inner ends.

* * * * *